US012650128B2

(12) United States Patent
Chiu et al.

(10) Patent No.: US 12,650,128 B2
(45) Date of Patent: Jun. 9, 2026

(54) ROTARY COMPRESSOR FOR RAPID FREEZING APPLIANCES

(71) Applicant: RECHI PRECISION CO., LTD., Taoyuan Clty (TW)

(72) Inventors: Chung-Pen Chiu, Taoyuan City (TW); Chin-Hui Hsu, Taoyuan City (TW)

(73) Assignee: RECHI PRECISION CO., LTD., Taoyuan City (TW)

( * ) Notice: Subject to any disclaimer, the term of this patent is extended or adjusted under 35 U.S.C. 154(b) by 0 days.

(21) Appl. No.: 19/014,591

(22) Filed: Jan. 9, 2025

(65) Prior Publication Data

US 2026/0153088 A1 Jun. 4, 2026

(30) Foreign Application Priority Data

Dec. 3, 2024 (CN) ..... 202411763721.8

(51) Int. Cl.
*F04C 18/356* (2006.01)
*F25B 31/02* (2006.01)

(52) U.S. Cl.
CPC ..... *F04C 18/3564* (2013.01); *F25B 31/026* (2013.01)

(58) Field of Classification Search
CPC ..... F04C 18/3564; F25B 31/026
See application file for complete search history.

(56) References Cited

U.S. PATENT DOCUMENTS

2004/0009083 A1* 1/2004 Kim ..... F04C 23/008 418/23
2016/0084202 A1* 3/2016 Brown ..... F02D 19/00 60/599

FOREIGN PATENT DOCUMENTS

CN 102562598 A * 7/2012 ..... F04C 23/008

OTHER PUBLICATIONS

English Translation CN-102562598-A (Year: 2012).*

* cited by examiner

*Primary Examiner* — Shafiq Mian
(74) *Attorney, Agent, or Firm* — MUNCY, GEISSLER, OLDS & LOWE, P.C.

(57) ABSTRACT

The present invention provides a rotary compressor for rapid freezing appliances. The rotary compressor can be used to charge a refrigerant selected from one of either R1270 or R290. The rotary compressor includes a pump, a ring and a shaft. The pump includes an upper support, a cylinder, a lower support and vanes. The cylinder has a suction port used to draw in refrigerant. The upper support has a discharge port used to discharge refrigerant. The discharge port has a depth not more than 2 millimeters and an effective area between 28 square millimeters and 51 square millimeters. The ring has a height-to-radius ratio between 1.4 and 1.7. The shaft can be rotated relative to a first longitudinal axis of the pump to enable the ring to rotate relative to the pump.

7 Claims, 3 Drawing Sheets

ROTARY COMPRESSOR FOR RAPID FREEZING APPLIANCES

RELATED APPLICATIONS

This application claims priority to China Application Serial Number 202411763721.8, filed Dec. 3, 2024, which is herein incorporated by reference.

BACKGROUND

Technical Field

The present invention relates to a rotary compressor, and in particular, to a rotary compressor for rapid freezing appliances.

Description of Related Art

In the technical field of refrigeration, the existing refrigeration system usually adopts a reciprocating compressor with a refrigerant for refrigeration. However, the reciprocating compressor compresses the refrigerant through the reciprocating motion of the piston, which results in a slow pressure constituting process and makes it difficult to achieve rapid refrigeration effects.

Therefore, this is still a problem that must be continuously overcome and solved by the developers of compressors and other related industries.

SUMMARY

This Summary is provided merely to summarize some example embodiments, so as to provide a basic understanding of some aspects of the subject matter described in the present disclosure. Accordingly, the features described in this Summary are merely examples and should not be construed to narrow the scope or spirit of the subject matter described herein in any way. Other features, aspects, and advantages of the subject matter described herein will become apparent from the following Detailed Description, Figures, and Claims.

According to one aspect of the present disclosure, a rotary compressor for rapid freezing appliances is disclosed. The rotary compressor can be used to charge a refrigerant selected from one of either R1270 or R290. The rotary compressor includes a pump, a ring and a shaft. The pump includes a first longitudinal axis, and the pump includes an upper support, a cylinder, a lower support and a vane. The upper support includes a discharge outlet. The discharge outlet includes a depth less than 2 millimeters, and the discharge outlet includes an effective area between 28 square millimeters and 51 square millimeters. Wherein the discharge outlet is used to discharge the refrigerant. The cylinder is attached to the upper support. The cylinder includes a suction port, and the suction port is used to draw in the refrigerant. The lower support is disposed on a side away from the upper support, and the upper support, the cylinder and the lower support collectively constituting a chamber. The ring includes a second longitudinal axis parallel to and spaced from the first longitudinal axis, and the ring is disposed within the pump, wherein the ring includes a height-to-radius ratio between 1.4 and 1.7. The shaft penetrates along the first longitudinal axis and contacts the ring. The shaft can rotate relative to the first longitudinal axis to enable the ring to rotate relative to the pump. The vane extends from an outer side of the pump into the chamber and the vane contacts an outer side of the ring.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
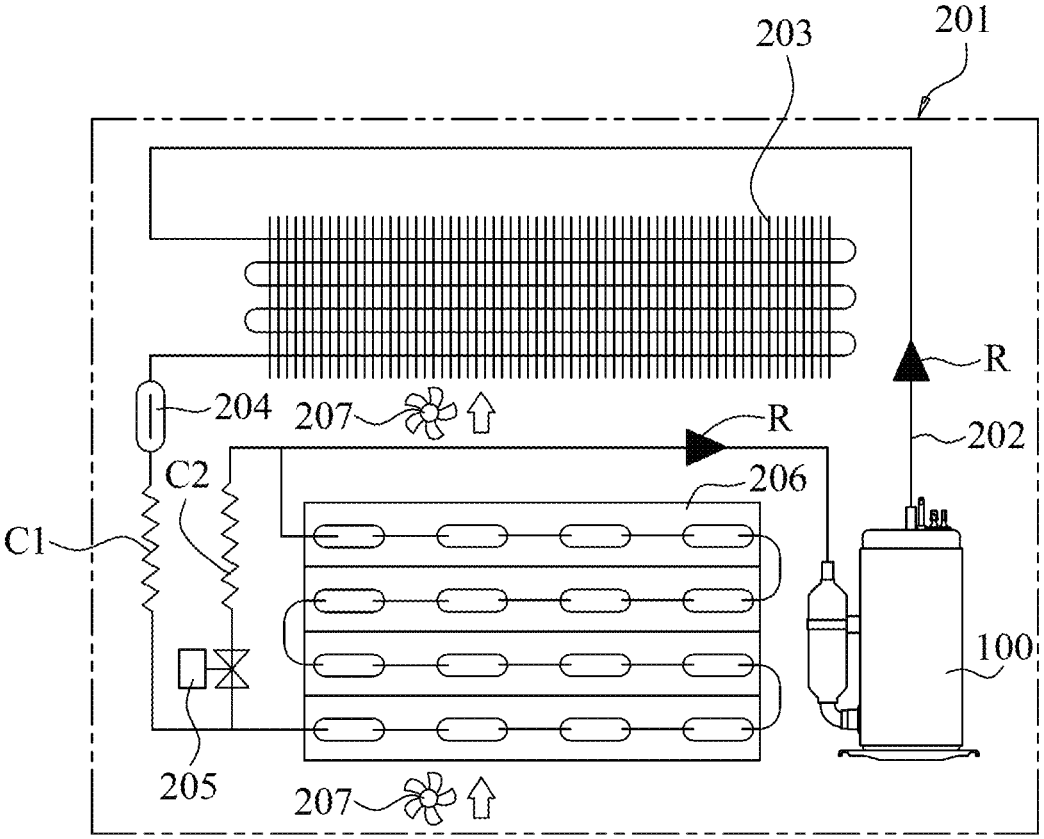
FIG. 1 is a schematic diagram of a system of a rapid freezing appliance according to one embodiment of the present disclosure.
Figure 2:
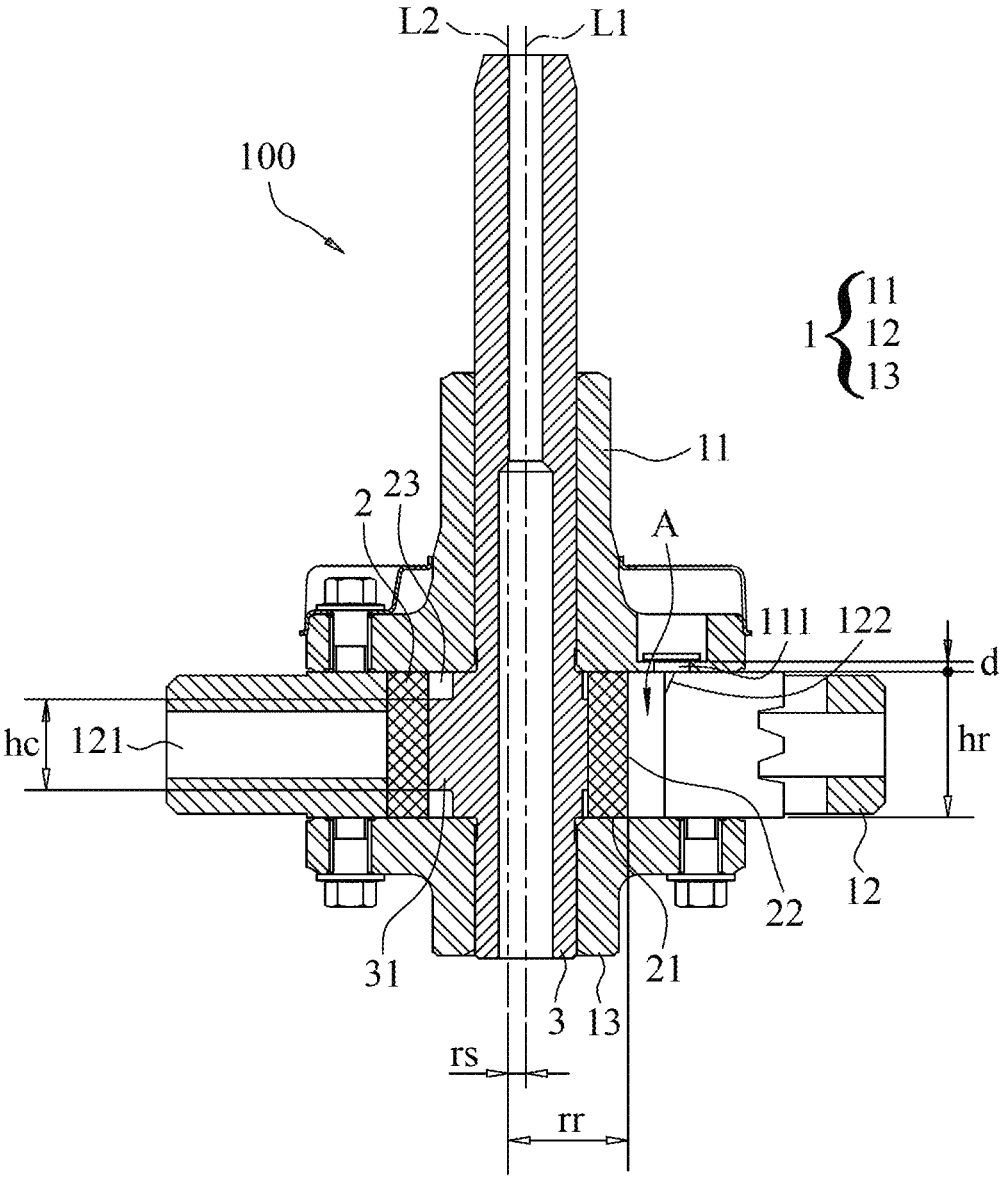
FIG. 2 is a sectional view along an axial direction of a rotary compressor according to one embodiment of the present disclosure.
Figure 3:
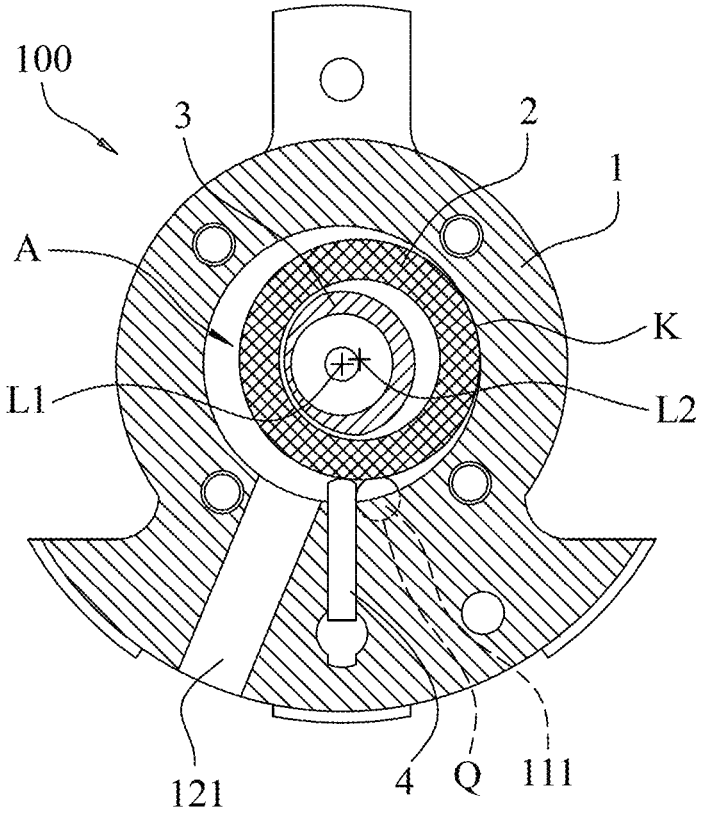
FIG. 3 is a sectional view along a radial direction of a rotary compressor according to one embodiment of the present disclosure.

Referring to FIGS. 1 to 3, an rapid freezing appliance 201 includes a rotary compressor 100, a refrigerant tube 202 connected to the rotary compressor 100, a condenser 203 (e.g., tube-fin condenser) connected to the refrigerant tube 202, a filter 204 connected to the condenser 203, a capillary tube C1 connected to the filter 204, a flow restrictor 205 (e.g., valve) connected to the capillary tube C1, a capillary tube C2 connected to the flow restrictor 205, an evaporator 206 connected to the flow restrictor 205, and a plurality of fans 207. In some embodiments, the rotary compressor 100 can be utilized alone (e.g., implemented, manufactured, sold, etc.) or in combination with other components.

As shown in FIG. 1, the condenser 203, the filter 204, the restrictor 205, the evaporator 206 and the rotary compressor 100 can be sequentially connected in series from the refrigerant tube 202 to form a path for a refrigerant R. In addition to the rapid freezing appliance 201, in some embodiments, the rotary compressor 100 can also be used in a heat pump system, but it is not limited herein.

In practice, the rapid freezing appliance 201 can be used in household appliances. The household appliance includes the rapid freezing appliance 201 and the household appliance may be an ice cream maker, but it is not limited herein. In some examples, the household appliance may be a refrigeration appliance such as a refrigerator, an air conditioner, a water dispenser, or an ice water/ice dispenser.

It should be noted that the rotary compressor 100 can be used to charge a refrigerant R (e.g., a flammable refrigerant), and the refrigerant R is selected from one of either R1270 or R290, but the selection of the refrigerant can be adjusted according to the design requirements, and it is not limited herein. Further, the rotary compressor 100 in this embodiment can effectively improve the refrigeration efficiency of the rotary compressor 100 by using a specific refrigerant R of R1270 or R290.

As shown in FIGS. 2 and 3, the rotary compressor 100 includes a pump 1 having a first longitudinal axis L1, a ring 2 disposed within the pump 1, a shaft 3 penetrating along the first longitudinal axis L1 and contacting the ring 2, and a vane 4 disposed within the pump 1.

The structure of each component of the rotary compressor 100 will be described in the following paragraphs, and the collocation relationship between each component will also be described appropriately. As shown in FIG. 2, the pump 1 includes an upper support 11, a cylinder 12 attached to the upper support 11, and a lower support 13 located on a side away from the upper support 11, and the upper support 11, the cylinder 12, and the lower support 13 collectively constitute a chamber A.

The cylinder 12 includes a suction port 121, and the suction port 121 is capable of suctioning the refrigerant R. The upper support 11 includes a discharge port 111, and the discharge port 111 is capable of discharging the refrigerant R. Further, the discharge port 111 includes a depth d in the direction of the first longitudinal axis L1, and the depth d is not greater than 2 millimeters (mm).

In more detail, the discharge outlet 111 includes a first area relative to the lower support 13 and the discharge outlet 111 includes an effective area Q between 28 square millimeters ($mm^2$) and 51 square millimeters ($mm^2$). It should be noted that the effective area Q is a portion of the first area of the discharge outlet 111 that is not covered by the cylinder 12.

In one embodiment, the cylinder 12 includes a concave portion 122 to avoid the cylinder 12 from blocking the discharge outlet 111, thereby making the effective area Q almost equal to the first area. The configuration between the cylinder 12 and the discharge outlet 111 of the lower support 13 may be adjusted and varied according to the design requirements, it is not limited herein.

Further, by increasing the effective area Q of the discharge outlet 111, the pressure drops of the refrigerant R passing through a valve (e.g., a restrictor) can be reduced, which in turn can reduce energy losses (e.g., motor losses) and further enhance the operating efficiency of the rotary compressor 100 (i.e., enhance the refrigeration efficiency). In other word, the rotary compressor 100 is able to reduce the pressure drop of the refrigerant R when passing through a valve (e.g., a restrictor) by the effective area Q of the discharge outlet 111, thereby increasing the refrigeration efficiency of the rotary compressor 100.

As shown in FIGS. 2 and 3, the ring 2 includes a second longitudinal axis L2 parallel to and spaced from the first longitudinal axis L1, and the ring 2 is eccentrically disposed with respect to the pump 1 (i.e., the ring 2 is disposed with the second longitudinal axis L2 as the center, and the pump 1 is disposed with the first longitudinal axis L1 as the center).

Further, the ring 2 includes a height-to-radius ratio between 1.4 and 1.7. It is noted that the height-to-radius ratio is the ratio of a height hr of the ring 2 to a radius rr of an outer side 22 of the ring 2 with respect to the second longitudinal axis L2 (i.e., hr/rr). It is also noted that the ring 2 includes a contact line K in contact with an inner side of the cylinder 12, and the length of the contact line K can correspond to the height hr of the ring 2.

In more detail, a lower end surface 21 of the ring 2 can be supported by the lower support 13 and the lower end surface 21 of the ring 2 can move (e.g., rotate) along the lower support 13. Specifically, the ring 2 is rotated relative to the pump 1 by the shaft 3.

As shown in FIGS. 2 and 3, the shaft 3 is eccentrically disposed with respect to the pump 1 (i.e., both the shaft 3 and the pump 1 can be disposed with the first longitudinal axis L1 as the center). Further, the shaft 3 is penetrating through the upper support 11, the cylinder 12, and the lower support 13, and the upper support 11 is a shaft sleeve to provide the arrangement of the shaft 3.

Referring to FIG. 2, the shaft 3 in this embodiment further includes a cam 31 located within the chamber A, and the cam 31 is capable of contacting an inner side 23 of the ring 2. Further, the cam 31 has a height hc not greater than 24 mm, and the height he is preferably between 10 mm and 16 mm, but may be adjusted according to the design requirements. In more detail, the shaft 3 includes a minimum radius rs not greater than 9 millimeters with respect to the first longitudinal axis L1 (i.e., a portion of the shaft 3 that does not include the cam 31).

It should be noted that the shaft 3 is connected to a motor (not shown). Specifically, when the motor drives the shaft 3 to rotate, the shaft 3 is able to press the ring 2 against an inner surface on the cylinder 12 by the cam 31, and the cam 31 is able to rotate the ring 2 along the inner surface of the cylinder 12, but it is not limited herein. In some embodiments, the shaft 3 may also be a bearing contacting the ring 2 and rotate relative to the inner side 23 of the ring 2.

Further, the contact line K can depict a closed ring when the shaft 3 rotates to rotate the ring 2 along the inner side of the cylinder 12. According to the above configuration, when the ring 2 completely rotates relative to the inner side of the cylinder body 12 via the shaft 3, a displacement of the rotary compressor 100 is between 13.5 cc and 26 cc, and the displacement of the rotary compressor 100 is preferably between 15 cc and 18 cc, but it is not limited herein.

It is also noted that the individual components of the rotary compressor 100 rotate at different speeds during operation, and the difference in speed causes friction between the individual components. By reducing the height hc of the cam 31 during operation of each component of the rotary compressor 100, the frictional contact area between the cam 31 and the inner side 23 of the ring 2 can be reduced, thereby reducing friction losses between the cam 31 and the ring 2. Further, by reducing the height-to-radius ratio (hr/rr) of the ring 2, it is possible to reduce the frictional contact area between other components (e.g., pump 1) and the ring 2, thereby reducing friction losses of the ring 2. As well, by reducing the minimum radius rs of the shaft 3, the frictional contact area between other components (e.g., pump 1) and the shaft 3 can be reduced to reduce friction losses.

Accordingly, in the present invention, the rotary compressor 100 is able to significantly reduce friction losses between the various components of the rotary compressor 100 through the design of the height-to-radius ratio (hr/rr) of the ring 2, the design of the minimum radius rs of the shaft 3, and the design of the height hc of the cam 31, and thus can effectively improve the operating efficiency (i.e., can improve the refrigeration efficiency) of the rotary compressor 100. In other words, the components of the rotary compressor 100 can operate with low friction losses.

In one embodiment, the shaft 3 is a hollow cylinder so that the shaft 3 can be further connected to an oil pump (not shown). Specifically, the oil pump can be used to supply an oil, and the oil can be supplied to the rotary compressor 100 via the shaft 3.

Further, the oil preferably includes a volume between 150 cc and 270 cc, and the oil is capable of providing lubrication for the operation of the various components of the rotary compressor 100, further reducing friction losses in the operation of the various components. In more detail, the oil is selected from one of a PAG type oil (i.e., polyethylene glycol synthetic oil) and a POE type oil (i.e., polyol ester). Further, the PAG-type oil has a kinematic viscosity between 90 cSt and 110 cSt at a temperature of 40° C., and the POE-type oil has a kinematic viscosity between 62 cSt and 74 cSt at a temperature of 40° C.

As shown in FIG. 2, the vane 4 extends from the outside of the pump 1 into the chamber A, and the vane 4 is able to contact the outer side 22 of the ring 2. Specifically, as the ring 2 rotates, the vane 4 is able to slide in and out of the chamber A to draw in the gas and contact the outer side 22 of the ring 2, forming enclosed spaces of different sizes in the chamber A, thereby enabling efficient compression of the gas.

According to the above configuration, the rotary compressor 100 of the present invention is capable of completing refrigeration in a time less than 90 seconds, and the time is preferably not greater than 70 seconds.

In practice, when the rapid freezing appliance 201 (e.g., ice cream maker) employs the rotary compressor 100, it takes only about 60 seconds to complete refrigeration. However, when the rapid freezing appliance 201 (e.g., ice cream maker) utilizes a conventional reciprocating compressor, the conventional reciprocating compressor takes about 120 seconds to complete refrigeration. Accordingly, the rotary compressor 100 of the present invention has a better refrigeration effect compared to the conventional reciprocating compressor.

In summary, the rotary compress for rapid freezing appliances disclosed in present invention can select the specific refrigerant R1270 or R290, and through the design of "the discharge port includes the effective area between 28 square millimeters ($mm^2$) and 51 square millimeters ($mm^2$)", it can reduce the pressure drop when the specified refrigerant R1270 or R290 passing through a valve (e.g. a restrictor), thereby effectively increasing the operating efficiency of the rotary compressor and simultaneously enhancing the refrigeration efficiency.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A rotary compressor for rapid freezing appliances, the rotary compressor can be used to charge a refrigerant selected from one of either R1270 or R290, the rotary compressor comprising:

a pump comprising a first longitudinal axis, the pump comprising:

an upper support comprising a discharge outlet, the discharge outlet comprising a depth less than 2 millimeters and an effective area between 28 square millimeters and 51 square millimeters, wherein the discharge outlet is used to discharge the refrigerant;

a cylinder attached to the upper support, the cylinder comprising a suction port, and the suction port being used to draw in the refrigerant; and a lower support disposed on a side away from the upper support, and the upper support, the cylinder and the lower support collectively constituting a chamber;

a ring comprising a second longitudinal axis parallel to and spaced from the first longitudinal axis, and the ring being disposed within the pump, wherein the ring comprises a height-to-radius ratio between 1.4 and 1.7;

a shaft penetrating along the first longitudinal axis and contacting the ring, the shaft being capable of rotating relative to the first longitudinal axis to enable the ring to rotate relative to the pump; and a vane extending from an outer side of the pump into the chamber, and the vane being capable of contacting an outer side of the ring, wherein the shaft further comprises a cam disposed within the chamber, the cam contacts an inner side of the ring, and the cam comprises a height not greater than 24 mm.

2. The rotary compressor of claim 1, wherein the height of the cam is between 10 mm and 16 mm.

3. The rotary compressor of claim 2, wherein a portion of the shaft that excluding the cam comprises a minimum radius not greater than 9 mm relative to the first longitudinal axis.

4. The rotary compressor of claim 1, wherein a displacement of the rotary compressor is between 13.5 cc and 26 cc.

5. The rotary compressor of claim 4, wherein the displacement of the rotary compressor is between 15 cc and 18 cc.

6. The rotary compressor of claim 1, wherein the rotary compressor further comprises an oil, the oil is selected from one of either a PAG-type oil or a POE-type oil, the PAG-type oil comprises a kinematic viscosity between 90 cSt and 110 cSt at a temperature of 40° C., and the POE-type oil comprises a kinematic viscosity between 62 cSt and 74 cSt at a temperature of 40° C.

7. The rotary compressor of claim 6, wherein a volume of the oil is between 150 cc and 270 cc.

* * * * *